US006792711B2

(12) United States Patent
Battaglia

(10) Patent No.: US 6,792,711 B2
(45) Date of Patent: Sep. 21, 2004

(54) FIREARM ADAPTER RAIL SYSTEM

(75) Inventor: Vincent Battaglia, Easton, CT (US)

(73) Assignee: Colt's Manufacturing Company, Inc., Hartford, CT (US)

( * ) Notice: Subject to any disclaimer, the term of this patent is extended or adjusted under 35 U.S.C. 154(b) by 0 days.

(21) Appl. No.: 10/174,225

(22) Filed: Jun. 17, 2002

(65) Prior Publication Data

US 2003/0230022 A1 Dec. 18, 2003

(51) Int. Cl.[7] ..... F41C 27/00
(52) U.S. Cl. ..... 42/114; 42/142; 42/146; 42/90
(58) Field of Search ..... 42/112, 114, 115, 42/117, 142, 146, 90

(56) References Cited

U.S. PATENT DOCUMENTS 4,571,870 A * 2/1986 Heideman et al.
5,107,612 A * 4/1992 Bechtel ..... 42/103
5,198,600 A 3/1993 E'Nama ..... 42/90
5,343,650 A * 9/1994 Swan ..... 42/75.01
5,533,292 A * 7/1996 Swan ..... 42/100
5,826,363 A 10/1998 Olson ..... 42/75.01
6,115,952 A 9/2000 Rigler ..... 42/103
6,134,823 A 10/2000 Griffin ..... 42/105

FOREIGN PATENT DOCUMENTS

DE 40 26 483 A1 * 11/1991

* cited by examiner

*Primary Examiner*—Stephen M. Johnson
(74) *Attorney, Agent, or Firm*—Perman & Green, LLP

(57) ABSTRACT

A firearm rail adapter system for mounting accessories on a firearm. The system comprises a first mount, a second mount, and an adapter rail. The first mount is adapted to be mounted to the firearm and has rail attachment sections thereon. The second mount is adapted to be mounted to the firearm and has other rail attachment sections thereon. The adapter rail is adapted to be removably mounted to at least one of the rail attachment sections of the first mount, and to at least one of the other rail attachment sections of the second mount. The rail attachment sections and the other rail attachment sections are disposed respectively on the first mount and second mount so that when the first mount and second mount are mounted to the firearm, the first mount and second mount provide a number of different selectable mounting stations for mounting the adapter rail to the firearm.

36 Claims, 10 Drawing Sheets

FIREARM ADAPTER RAIL SYSTEM

BACKGROUND OF THE INVENTION

1. Field of the Invention

The present invention relates to firearms and, more particularly, to a firearm adapter rail system for mounting accessories to the firearm.

2. Brief Description of Earlier Developments

The original M16 rifle was developed in the 1960's. During the original development, the hand guard system employed on the rifle, was merely that, a hand guard, the forward hold for the weapon including its mounting configuration to the weapon. The original accessories for the M16 included scope mounting to the handle portion, carry sling and bayonet mounting to the front sight casting. The devices and attachments used today simply did not exist at the time of the rifle design. Therefore, no consideration was given to supplemental device mounting.

As technology has progressed since the time of first development of the M16 rifle, supplemental devices and accessories have been developed in order to enhance the use of the rifle. Presently, the M4 type rifles and carbines (the current descendents of the original M16 type rifle) may be integrated with numerous supplemental devices and accessories such as cameras, lasers, lights and a host of other electronic and mechanical gear. Also, secondary weapon system integration may be performed with the M4 such as grenade launchers, shot gun type devices for lethal and nonlethal deployment and other such means. The supplemental devices may be integrated with the M4 type rifle and carbine by military, police, and civilian users (in the case of civilian users possibly with the exception of the secondary weapon systems and using restricted law enforcement and military versions of the M4 type rifle). Furthermore, in the hands of the military, the M4 type firearm has morphed into an M4 type weapon system. This versatility has been demonstrated through the U.S. Army's "Land Warrior System" mounting several pieces of electronics to the M4 including cameras, digital compasses and specific electronics. This "state of the art" use of an M16 type weapon has given rise to the desire for mounting several pieces of apparatus at once onto the weapon.

As the number of different types of supplemental devices has proliferated, creating a suitable mounting platform for the devices to M16 types has been an on going pursuit of the government and manufacturers. The government has standardized the actual mounting surface between devices ad mounting adapter through Military Standard 1913 (MIL-STD-1913) which depicts and describes the "Piccatiny Rail" configuration. This rail configuration has been merged into recent M16 designs such as the M16A4 flat-top rail on the upper receiver handle portion, allowing the handle to be removed and attachments to be placed. This rail position alone is not sufficient to satisfy the ever growing desire of users to further mount supplemental devices. For example with an optical scope or camera mounted on the integral rail on the upper receiver, the user may further desire to mount a flash light and laser pointer to the M4 weapon. All these devices however, cannot be mounted at the same time utilizing only the integral rail. Accordingly, various schemes have been devised to provide the M4 type weapon with additional mounting rails.

A number of the schemes for mounting supplemental devices involve using the hand guard system of the M4 in some way with a deleterious over all effect to the M4 firearm. The current M16 type rifle derivation, the M4 manufactured by Colt's Manufacturing for example, has become the standard weapon of choice for many police and military groups because of its compact design, accuracy and feature level. One of its hailed features is the double heat shield hand guard system, which is disclosed in U.S. Pat. No. 4,663,875. Not only does it create superior barrel heat shielding in burst and full auto, it has a ergonomic hold of the rifle due to the natural grasp shape. The M4 hand guard has become an integral look as well as a standard hold of the M4 rifle. However, the present M4 style hand guard mounting system was never intended to carry supplemental devices, especially heavy electronics that require exact repeatable placement with forced centerline geometry to the barrel. The original intent of the design was merely an ingenious and fast way to affix the hand guard to the rifle and nothing else. The present construction including the rear cap urged by its extension spring into the taper of the plastic in the rear of the hand guard and its corresponding forward stationary metal stamped cup docking the front portion of the hand guard, cannot create an adequate foundation for supplemental device mounting. Present rail type devices using the existing hand guard mounting technique prove inadequate for repetitive mounting and unmounting of supplemental devices. Also, combination rail and hand guard devices of a "free floating" concept compound the geometry considerations with an unsupported beam creating a completely unsatisfactory situation.

One example of a rail adapter hand guard system is disclosed in U.S. Pat. No. 5,826,363 which provides a replacement hand guard, replacing the original hand guard on M16 type rifles and carbines. The replacement hand guard has accessory adapter rails affixed directly to the hand guard, and the replacement hand guard is mounted on the weapon using the mounting configuration of the original hand guard which it replaces. The replacement hand guard has four fixed rail portions equally distributed around the circumference of the hand guard with one rail portion located at the top most section of the hand guard.

The current rail type devices or systems, such as exemplified by the device in U.S. Pat. No. 5,826,363, suffer from several deficiencies. First is the simple matter of choice, in that in order to use a forward rail system the user has to abandon the M4 hand guard and replace it with one of the replacement units. This adds extreme cost to the basic weapon price and permanently alters its configuration. The operator also loses the intended barrel heat shielding characteristics of the double heat shield design of the original hand guard. Generally, the replacement hand guard rail type systems are constructed from aluminum which conducts heat from the barrel and brings the hand guard to the operating temperature of the barrel rapidly, creating discomfort for the operator.

Manufactured from an aluminum extrusion the mounting portion of the replacement hand guard comes in direct contact with the barrel conducting or convecting heat directly to the users hand, creating an undesirable situation. Aluminum has very fast heat transfer properties, which only permit a short time of use before the aluminum hand guard approaches the operating temperature of the barrel. Because of aluminum's heat properties, it is slow to dissipate the heat, rendering the use of the weapon in an inefficient manner. To compound this problem, the replacement rail type hand guards do not provide an ergonomic grip for the operator. When grasping the hand guard, the operator's hand grips the corners and edges of the rails which are part of the hand guard.

Accuracy of the placement of the supplemental devices in relation to the centerline of the barrel is also an issue when employing the present rail type hand guards. As can realized, the accuracy of the placement of the supplemental devices is directly dependent on how accurately the mounting rail on the rail type hand guard is placed in relation to the barrel centerline. This in turn depends on the placement of the rail type hand guard on the firearm. However, the rail type hand guard systems, as noted before, merely employ the same mounting configuration as the original hand guard. The mounting configuration of the original hand guard on the M4 type firearms is intended only for mounting the hand guard on the M4. Hence, the placement accuracy of the hand guard mounting configuration is sufficient for mounting the hand guard itself to the firearm, but not for accurately locating supplemental devices on the firearm. For example, the hand guard on M4 type firearms has radial locating ridges which engage gas tube clearance slots of the barrel nut to rotationally position the hand guard of the firearm. Hence, at least the rotational position of the rails on a rail type hand guard is established by the position of the barrel nut gas tube clearance slots on the firearm. The rotational position of the gas tube clearance slots however can vary rotationally up to 3° due to tolerance stack up. Thus, the rails of the hand guard type rail systems can be out of square to the true sight plane of the weapon by up to 3 full degrees either clockwise or counter clockwise by the simple random event of where the barrel nut finds home. This variance is detrimental to having the supplemental devices accurately aligned or true to the sight plane of a firearm as well as to repeatability of installation between firearms. The rail type hand guard systems which employ a "free floating" mounting configuration also suffer certain deficiencies. For instance, a basic problem with the free floating concept is that nothing supports the rail system, and the rail system regardless of how rigid acts as a tuning fork every time the weapon is fired. The free floating rail type hand guards have proven deficient when deployed with scope or camera type devices. In use with a bipod, they can bend on the weapon. Hence, the free floating rail type hand guard is not desired for mission critical equipment.

The present invention overcomes the problems of the present supplemental device mounting systems as will be described in greater detail below.

OBJECTS OF THE INVENTION

It is one object of the invention to integrate a rail mounting firearm type such as for example a M4 type firearm without replacing the hand guard. Also rapid assembly of a rail system onto any M4 type rifle with use of the new front and rear orbiting rail carriers and the existing hand guard.

A further object of the invention is to create a modular rail system so that a rail could have from one to eight rotational placements in 45 degree increments but also be used for any existing M16 or M4 hand guard length by simply using a longer rail with the pre mounted orbiting rail carriers on any derivation rifle or carbine.

Another object of the invention is that the rear orbiting rail carrier replaces the standard M4 hand guard cap but integrates all of the existing mounting features and does not disturb the present hand guard mounting scenario.

Yet another object of the invention is to enable M16 type and M4 type firearms to easily be retrofitted with a firearm adapter rail system using the present invention, using ordinary tools.

SUMMARY OF THE INVENTION

In accordance with the first embodiment of the present invention, a firearm rail adapter system for mounting accessories on a firearm is provided. The system comprises a first mount, a second mount, and an adapter rail. The first mount is adapted to be mounted to the firearm. The first mount has rail attachment sections thereon. The second mount is adapted to be mounted to the firearm and has other rail attachment sections thereon. The adapter rail is adapted to be removably mounted to at least one of the rail attachment sections of the first mount, and to at least one of the other rail attachment sections of the second mount. The rail attachment sections and the other rail attachment sections are disposed respectively on the first mount and second mount so that when the first mount and second mount are mounted to the firearm, the first mount and second mount provide a number of different selectable mounting stations for mounting the adapter rail to the firearm.

In accordance with another embodiment of the present invention, a firearm rail adapter system for mounting accessories on a firearm is provided. The system comprises a first mount, a second mount, and an adapter rail. The first mount is adapted to be mounted to the firearm and has rail attachment sections thereon. The second mount is adapted to be mounted to the firearm and has other rail attachment sections thereon. The adapter rail is adapted to be removably mounted to at least one of the rail attachment sections of the first mount and to at least one of the other rail attachment sections of the second mount. The rail attachment sections and the other rail attachment sections are disposed respectively on the first mount and second mount so that the adapter rail can be mounted in a position on the firearm selected from a number of different selectable positions on the firearm. The selectable positions are different relative to the predetermined reference datum of the firearm.

In accordance with still another embodiment of the present invention, a firearm rail adapter system for mounting accessories on a firearm is provided. The system comprises a first mount, a second mount, and an adapter rail. The first mount is adapted to be mounted to the firearm. The first mount has rail attachment sections thereon. The second mount is adapted to be mounted to the firearm and has other rail attachment sections thereon. The adapter rail is adapted to be removably mounted to at least one of the rail attachment sections of the first mount, and to at least one of the other rail attachment sections of the second mount. The rail attachment sections and the other rail attachment sections are disposed respectively on the first mount and second mount to allow the adapter rail to be mounted on the firearm in a number of different selectable positions. The different selectable positions are different relative to a predetermined reference datum of the firearm.

In accordance with yet another embodiment of the present invention, a firearm rail adapter system for mounting accessories on a firearm is provided. The system comprises at least one adapter rail, a front mount, and a rear mount. The adapter rail is adapted for removably mounting firearm accessories thereon. At least one rail has front and rear rail attachment sections for attaching the rail to the firearm. The front mount is disposed proximal to a front end of a barrel of the firearm. The rear mount is disposed proximal to the rear end of the barrel. The front and rear mounts mount the at least one rail to the barrel of the firearm. The front mount is adapted to removably mate with the front rail attachment section, and the rear mount is adapted to removably mate with the rear rail attachment section. The rail is removably mountable in a number of different selectable positions on the front and rear mounts.

In accordance with still another embodiment of the present invention, a firearm is provided. The firearm comprises a receiver, a barrel connected to the receiver, a hand guard connected to the barrel, and an adapter rail mounting system. The adapter rail mounting system is adapted for mounting accessories to the firearm. The system comprises mounts with a number of different adapter rail attachment sections for attaching an adapter rail to the firearm. The different attachment sections allow the adapter rail to be mounted to the firearm in a number of different positions around the barrel of the firearm.

In accordance with yet another embodiment of the present invention, a kit is provided. The kit comprises an adapter rail, a first mount element, and a second mount element. The adapter rail is adapted for mounting accessories to a firearm. The first mount element is adapted for connecting the adapter rail to the firearm. The second mount element is adapted for connecting the adapter rail to the firearm.

BRIEF DESCRIPTION OF THE DRAWINGS

The foregoing aspects and other features of the present invention are explained in the following description, taken in connection with the accompanying drawings, wherein:

FIGS. 8–8A respectively are an exploded perspective view, and an end view of an adapter rail of the adapter rail system shown in FIG. 2.

DETAILED DESCRIPTION OF THE PREFERRED EMBODIMENT

Figure 1:
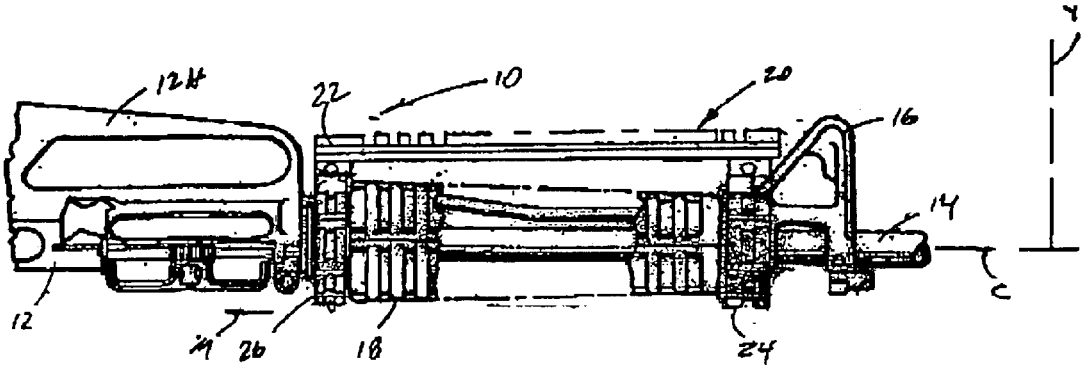
FIG. 1 is a schematic partial elevation view of a firearm incorporating features of the present invention.

Referring to FIG. 1, there is shown an exploded perspective view of a firearm 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2:
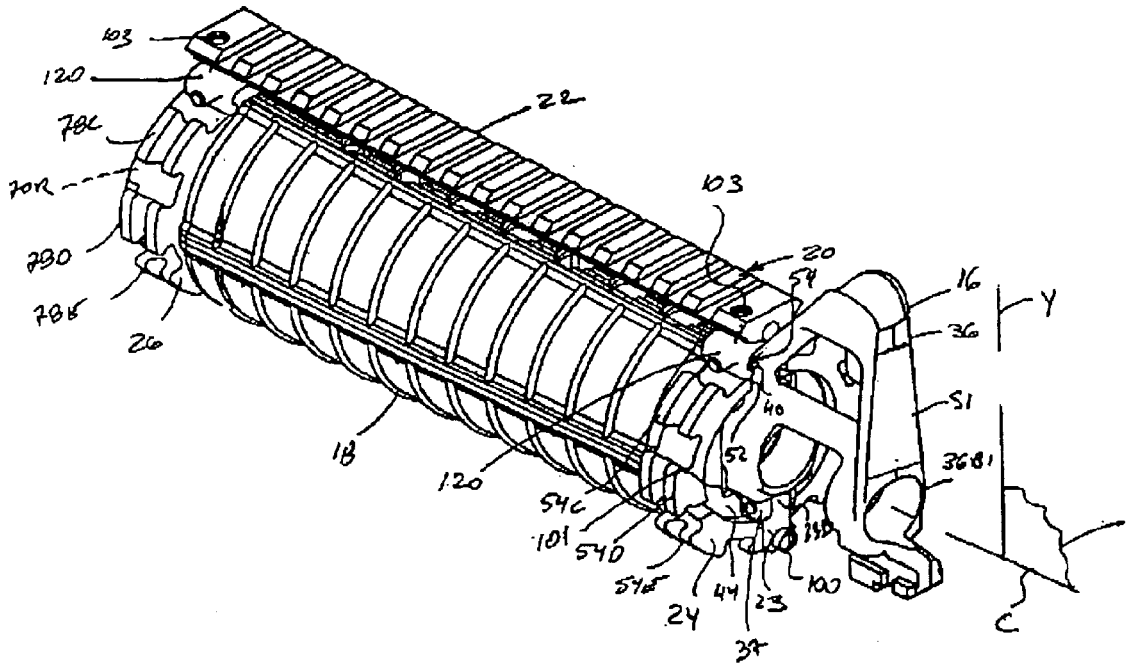
FIG. 2 is perspective view of a front portion of the firearm in FIG. 1 including a handguard assembly, front sight assembly and adapter rail system in accordance with a first embodiment of the present invention (the barrel being omitted for clarity)
Figure 3:
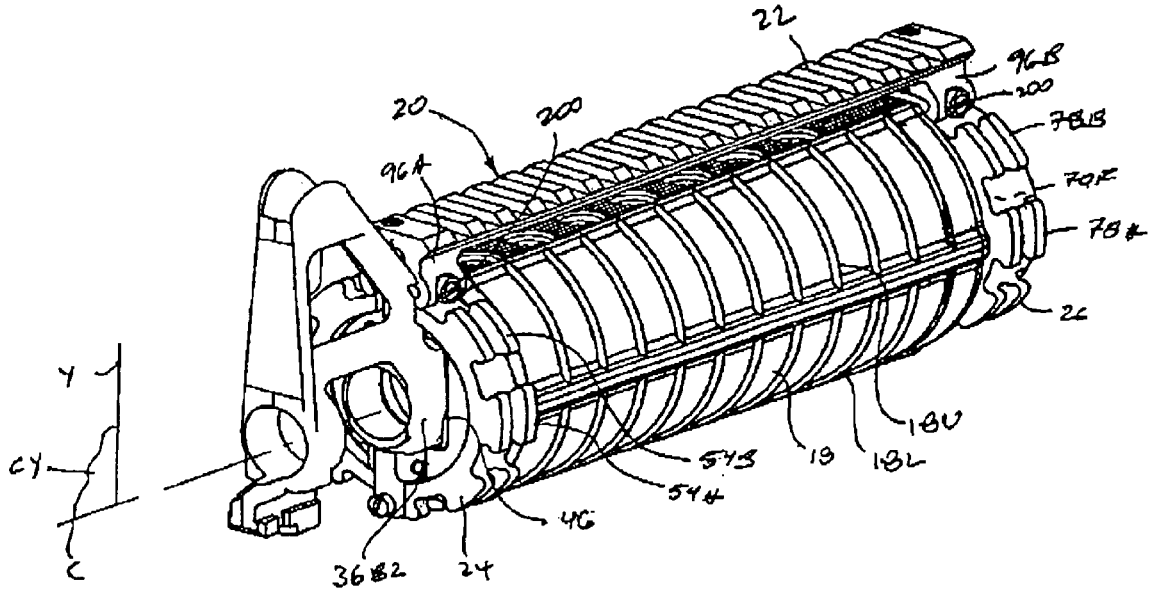
FIG. 3 is another perspective view of the front portion in FIG. 2 seen from the opposite direction.

The firearm 10 is shown in FIGS. 1–3 as being an M4 type firearm (such as an M4 rifle or carbine) for example purposes. The present invention, although described below with respect to an M4 type firearm, is equally applicable to any M16 type firearm or any other suitable firearm. Referring now also to FIGS. 2 and 3, which respectively show perspective views of a portion 11 of the firearm 10, the firearm 10 generally comprises a receiver 12 (only the upper portion of which is shown in FIG. 1 for example purposes), a barrel 14, a front sight assembly 16, a hand guard assembly 18, and an adapter rail assembly or system 20.

Figure 4:
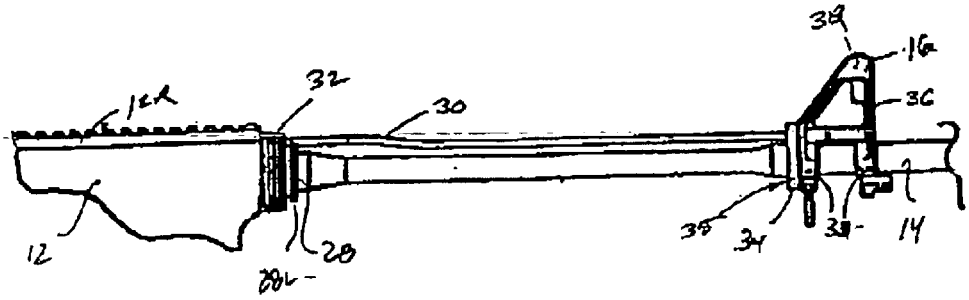
FIG. 4 is another schematic partial elevation view of the firearm with the adapter rail system removed and handguard removed.

The adapter rail assembly 20 generally comprises an adapter rail 22, a front rail carrier or mount 24, and a rear rail carrier or mount 26. The front and rear mounts 24, 26 are mounted to the barrel 14 in front and behind the hand guard assembly 18. The adapter rail 22 is mounted to the front and rear mounts 24, 26. The adapter rail assembly 20 is arranged around the hand guard assembly 18 and does not alter the hand guard in any way. The adapter rail 22 of the rail assembly 20 is aligned true to the barrel centerline axis C and to the sight plane CY (defined by centerline axis C and normal axis Y intersecting the centerline axis C as shown in FIG. 1) as will be described in greater detail below. The adapter rail 22 has a portion configured in accordance with MIL-STD-1913 for mounting firearm supplemental devices and accessories such as for example, electronic devices, scopes, lights, lasers and any other desired gear. Referring now to FIG. 4, there is shown another schematic elevation view of the firearm 10 with the hand guard assembly 18 and adapter rail assembly 20 omitted for clarity. The handle 12H (see FIG. 1) on the receiver 12 has also been omitted, revealing a rail 12R integrated to the top of the receiver. As seen in FIG. 4, the end of the barrel 14 is mounted into the receiver 12. A barrel nut 28 on the barrel 14 is threadably engaged to the receiver 12 to hold the barrel in the receiver. A gas tube 30 extends alongside the barrel 14. The gas tube 30 is connected to the barrel 14 and receiver 12 to return barrel gases to the firing mechanism in the receiver. Wave springs 32 are located around the barrel nut 28. The wave springs 32 are used to bias the hand guard assembly and hold the hand guard assembly in its installed position as will be described further below. The barrel nut 28 has a raised front radial flange or lip 28L as seen in FIG. 4. The lip 28L has a number of equally distributed scallops (not shown) around the outer lip circumference providing clearance passages for the gas tube 30 over the lip 28L.

The barrel 14 has the front sight assembly 16 fixedly mounted thereon proximate the front end of the barrel. A hand guard end cap 34 is mounted on the barrel 14 adjacent the front sight assembly 16 as seen in FIG. 4. The hand guard end cap 34 is substantially similar to conventional hand guard end caps generally used on M4 type firearms. Accordingly, the end cap, which may be a one-piece aluminum stamping, defines a shallow receptacle or cup 35 to receive a mating portion of the front end of the hand guard assembly. The hand guard assembly conforms with the hand guard assemblies generally used with M4 type firearms. One suitable example of a hand guard used with M4 type firearms is disclosed in U.S. Pat. No. 4,663,875, which is incorporated by reference herein. The hand guard end cap 34 has a through bore for mounting the cap on the barrel, and a gas tube porthole allowing the gas tube 30 to extend through the end cap. The end cap may be seated in an annular groove or shoulder formed into the exterior of the barrel 14 to hold the end cap fixed axially on the barrel.

Figure 5A:
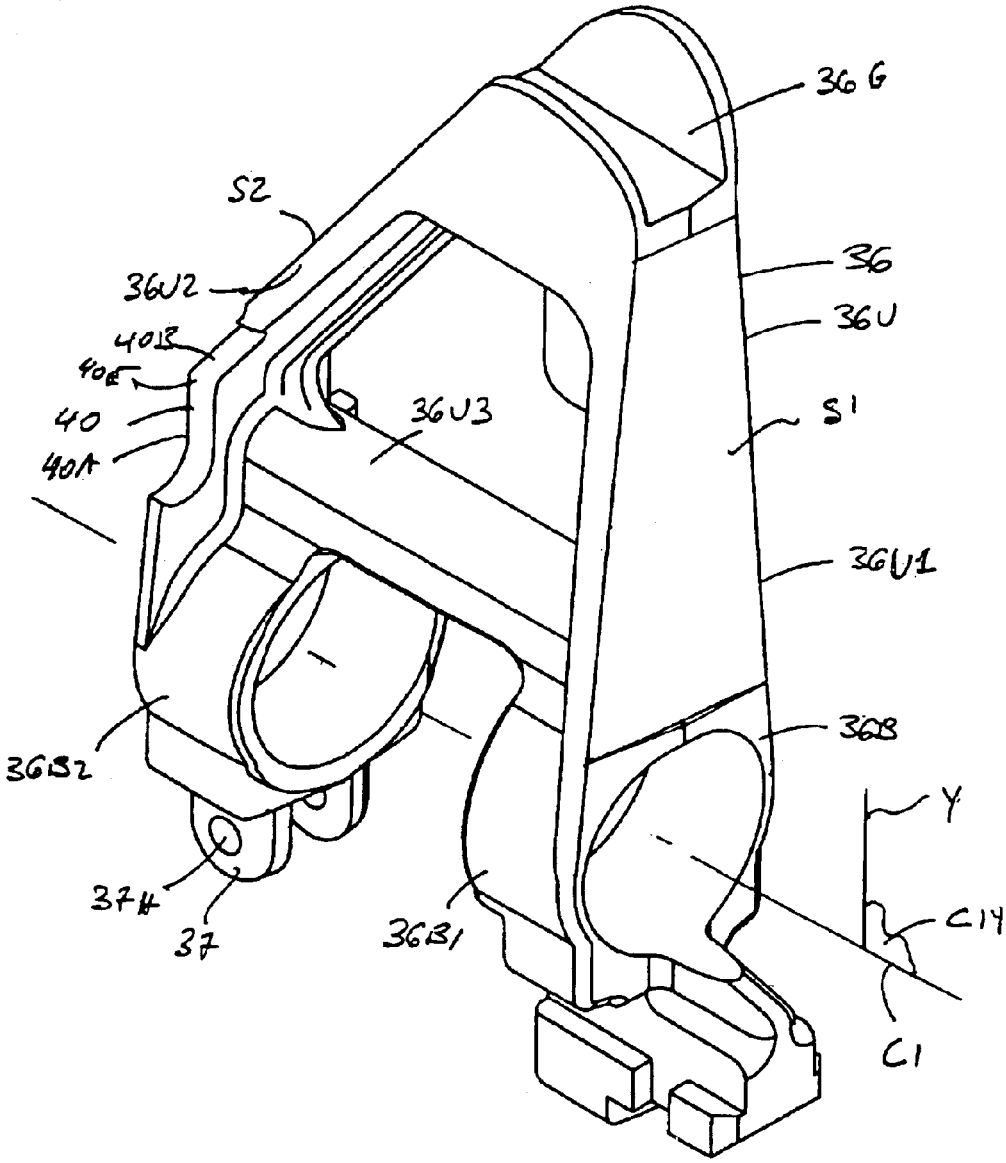
FIGS. 5A–5B respectively are a front perspective view and an end perspective view of the front sight assembly of the firearm in FIG. 1.
Figure 5B:
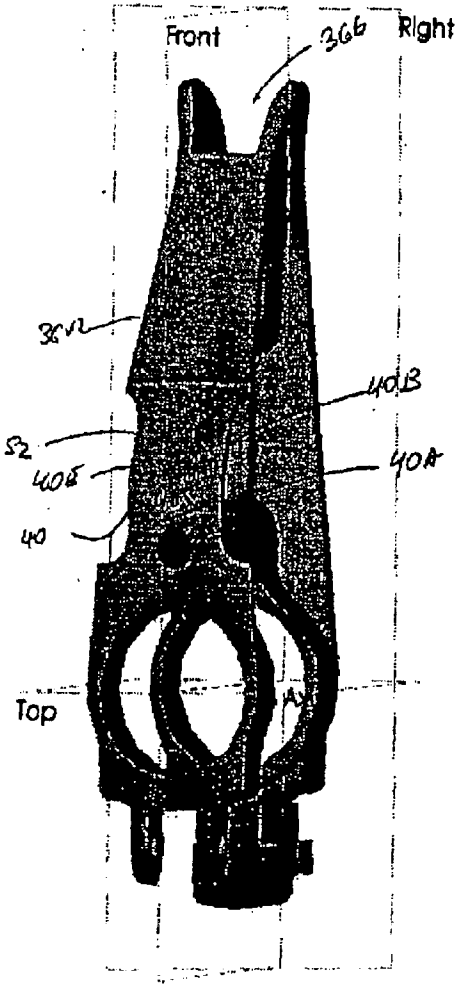

The front sight assembly 16, positioned on the barrel immediately in front of the end cap 34 as noted before, generally comprises a sight frame 36, a sight pin 38, and dowel or locating pins 33. The dowel pins are used to hold the sight assembly 16 precisely located on the barrel as will be described below. Referring now to FIGS. 5A–5B, there is shown respectively a perspective and an end view of the sight frame 36. Except as otherwise noted below, the sight frame is generally similar to frames of conventional front sight assemblies used generally with M4 type firearms. The sight frame is thus a one piece member which is formed or cast from suitable metal. The sight frame 36 may include a mounting section 36B with front and rear mounting rings 36B1, 36E2 for mounting the sight frame on the firearm barrel as shown in FIG. 4. As can be realized, the bores in the rings 36B1, 36E2 are aligned along centerline axis C1 which is substantially coincident with the centerline axis C (see FIG. 1) of the barrel 14 when the sight frame 36 is mounted on the barrel. Each mounting ring has passages (not shown) extending transverse to the centerline C1 for inserting dowel pins 33 (See FIG. 4) through the rings. The passages are located to allow the dowel pins 33, when inserted into the rings, to engage positioning slots (not shown) on the firearm barrel 14 extending through the rings thereby locking the sight frame 36 to the barrel both rotationally and longitudinally. As seen in FIG. 5A the sight frame 36 has an upper section 36U extending from the base section 36B. The upper section 36U in this embodiment has the recognizable triangular shape (when viewed in elevation) of conventional sights for M4 type firearms. The triangular shape of the upper section 36U is defined by a front upright leg 36U1, a rear brace leg 36U2, and a lower leg 36U3 spanning between the front and rear legs as shown in FIG. 5A. The upper section 36U terminates in a sight groove 36G (see FIG. 5B) in which the sight assembly 34 is mounted on the barrel. The sight pin 38 (see FIG. 1) positioned in the sight frame 36 is aligned in the same plane (i.e. plane C1Y which is coincident with sight plane CY when the sight is on the firearm) with centerline C1. As seen in FIGS. 5A–5B, the upper section 36U of the frame has a key 40 which is aligned with the sight plane, and may be formed as described below. In this embodiment, the front leg 36U1 has a datum surface S1 and the rear leg has another datum surface S2 (see FIGS. 5A, 5B). The front datum surface S1 is formed by machining, or any other suitable process, the as forged or cast face of the front leg to form a sufficiently flat datum surface which may be used as a locating surface for further machining or forming of the sight frame as will be described below. The datum surface S1 is oriented substantially perpendicular to plane C1Y. The datum surface S2 on the rear leg 36U2, seen best in FIG. 5B, is also formed by machining, or other suitable process, the rear surface of the rear leg. Datum surface S2 is substantially perpendicular to plane C1Y and angled with respect to datum surface S1. The datum surfaces S1 and S2 cooperate to provide a forced geometry to the sight frame in a holder (not shown) such as a machining jig for example, to allow formation of a key 40 (see FIGS. 5A–5B) in the sight frame which is aligned with plane C1Y (and hence the sight plane CY) of the firearm and true to the barrel centerline C when the sight assembly is mounted to the barrel. By way of example, when the sight frame 36 is placed in a machine tool holder (not shown), the angled datum surfaces S1, S2 seat the frame in the holder true to a reference plane coincident with plane C1Y Key 40 may then be machined or formed by any other suitable means into the frame 36 in alignment with the aforementioned reference plane. As seen best in FIG. 5B, in this embodiment the key 40 is formed into the rear leg 36U2. The key 40 may be located proximate the base of the rear leg, though in alternate embodiments the key may be formed on any suitable portion of the sight frame. In alternate embodiments, the sight frame may have any other suitable locating feature aligned with the firearm sight plane, formed by any other suitable means. In still other alternate embodiments, the sight frame may not have any locating features aligned precisely with the sight plane of the firearm.

As seen best in FIGS. 5A–5B, the key 40 has two portions 40A, 40B in this embodiment. The vertical portion 40A has a seating surface 40S. Both portions 40A, 40B have flat edges 40E which are substantially parallel to the reference plane C1Y (and hence the sight plane CY when the sight frame 36 is mounted to the barrel). The lateral edges 40E extending along the angled portion 40B of the key help align the adapter rail assembly 22 with the firearm sight plane CY as will be described in greater detail below.

Figure 6:
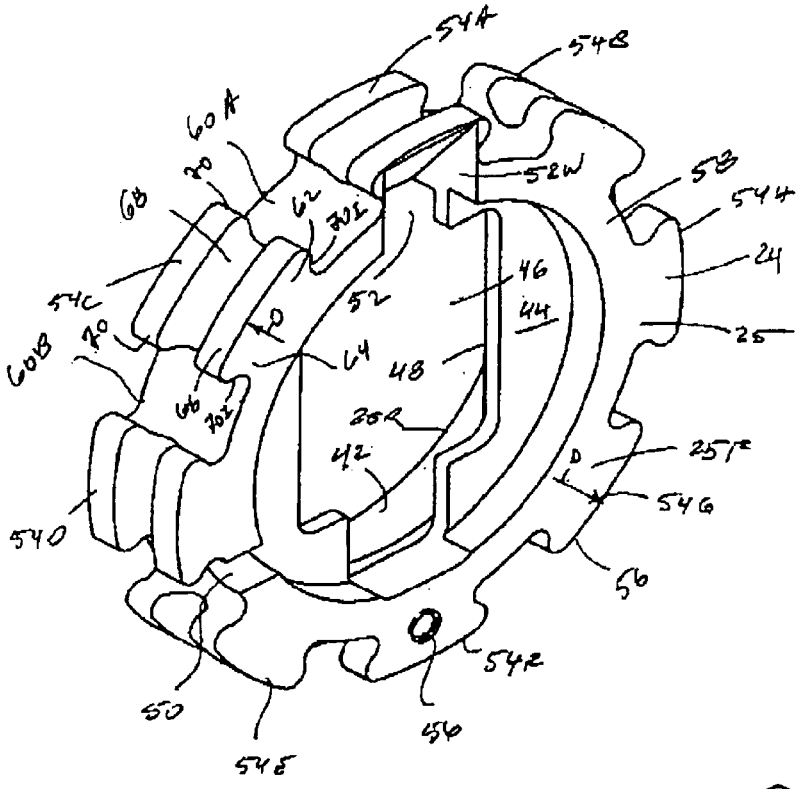
FIG. 6 is a perspective view of a front mount of the adapter rail system shown in FIG. 2.

As noted before, the adapter rail system 20 has front and rear mounts 24, 26 used to mount the adapter rail 22 the firearm (see FIGS. 1–3). Referring now to FIG. 6 there is shown a front end perspective view of the front mount 24. The front mount 24 in this embodiment has a frame 25 that is a one piece member which may be forged, cast, extruded or formed by any other suitable means from metal such as aluminum alloy, steel, or from non-metallic materials such as ceramics or plastics if desired. In alternate embodiments, the mounting frame may be made up of a number of parts that are assembled to form the mount. As seen in FIG. 6, in this embodiment frame 25 has a general circular ring shape, though in alternate embodiments the front mount frame may have any suitable shape. The frame 25 has an inner bore with a wall 44 located therein. The bore defines an inner seating surface 42 which extends from the wall 44 to the rear face 25R of the frame. The bore is sized so that the seating surface 42 forms a close fit with the lip extending around the hand guard assembly end cap 34 (see FIG. 4). In this embodiment, the wall 44 is offset to the rear from the front face 25F of the mount frame 25. The rear surface 48 of the wall 44 is disposed to abut the front face of the end cap 34 (see FIG. 4). As seen in FIG. 6, the wall 44 has an opening 46 formed therein. In this embodiment, the opening 46 has a generally rectangular shape, though the opening may have any suitable shape. Opening 46 is sized to provide a clearance hole for the rear mounting ring 36B2 of the front sight frame 36 to pass through wall 44. In other embodiments, the frame of the front rail mount may have an inner annular lip in place of the inner wall, or may have a hollow inner bore. As seen in FIG. 6, the frame 25 has a keyway 52 formed into the front face 25F. The keyway 52 is sized to conformaly receive the key 40 (see FIG. 5B) on the front sight frame 36. The side walls 52 W of the keyway 52 are oriented so that when the rail mount 24 is installed on the firearm, the walls 52W are aligned with the sight plane CY (see FIG. 1) of the firearm. As seen in FIG. 6 a fastener hole 56 is formed into frame 25 generally diametrically opposite the keyway 52. In this embodiment, the fastener hole 56 is threaded to engagingly receive a threaded fastener, such as a machine screw, or bolt.

Figure 6A:
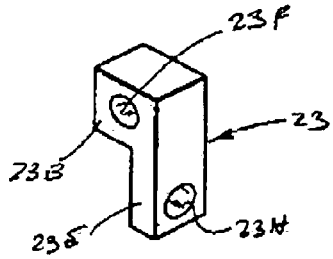
FIG. 6A is a perspective view of a catch used with the front mount in FIG. 6.

Still referring to FIG. 6, the front mount frame 25 has attachment sections 54A–54H disposed around the outer circumference 56 of the frame. The attachment sections 54A–54H may be used to mount the rail 22 to the mount 24 as will be described further below or may be used for attaching suitable supplemental devices directly to the mount. In this embodiment, the frame has eight (8) attachment sections 54A–54H distributed equally around the frame circumference. In alternate embodiments, the frame may have any suitable number of attachment sections. In the embodiment shown in FIG. 6, one attachment section 54A (the "first" attachment) is located at the top of the frame 25, over the keyway 52, so that when the mount is on the firearm, the sight plane CY substantially bisects the attachment 54A. In other embodiments, the "first" attachment section may be offset from the top of the frame by any desired angle. In still other embodiments, attachment sections may be distributed in any desired pattern or placed at any desirable locations on the outer circumference or anywhere on the mount frame. As seen in FIG. 6, the attachment sections 54A–54H in the embodiment are substantially similar to each other and will be described in detail below with specific reference to one attachment section 54C. In other embodiments, the mount frame may have different kinds of attachment sections. As seen in FIG. 6, the attachment section 54C projects radially outwards from the base section 58 of the frame. Channels 60A, 60B separate the attachment section 54C from adjacent attachment sections 54A, 54D. As seen in FIG. 6, the attachment section 54C has a head or seating portion 62 connected by a neck portion 64 to the base section 58. The head portion 62 has a curved outer surface 66 (which may be disposed along an arc of a major diameter D of the frame). The ends 70 of the head portion 62 overhang the neck portion 64, as seen in FIG. 6. The ends 70 may have a generally elliptical profile which transitions into the outer surface 66. The lower surfaces 70I of the ends 70 on the head section 62 provide seating surfaces for the rail clamps as will be described in greater detail below. As shown in FIG. 6A, a channel 68 is formed into the outer surface of the head section 62 to allow placement of a clamping fastener when the rail 20 is attached. In this embodiment, the channel 68 generally bi-sects the outer surface 66. As also seen in FIG. 6, the frame 25 may have a passage 50 formed through the base section 58 of the ring. The passage 50 provides access to the dowel pin 33 (see FIG. 4) in the rear mounting ring 36B2 of the front sight frame.

As seen in FIG. 2, a catch 23 may be used to lock the front mount 24 to the front sight assembly 16. Catch 23 is shown in FIG. 6A. Catch 23 is a one piece member which may be cast, forged or formed in any other suitable way. The catch 23 may be made from metal or ceramic material for example. In this embodiment, the catch 23 has a general inverted "L" shape with a block 23B and extension tab 23E cantilevered from the block. The block 23B is sized to be received in a clevis 37 extending from the rear mounting ring 36B2 of the front sight frame 36 as seen in FIG. 5A. The clevis is generally provided on sights as a strap attachment joint. A fastener through-hole 23F extends through the block section 23B to align with the fastener hole 37H in the clevis. A second fastener hole 23H is formed through the tab 23E to allow insertion of a fastener 100 (see FIG. 2) through the tab into threaded holes 56 in the mount frame 25.

Figure 7:
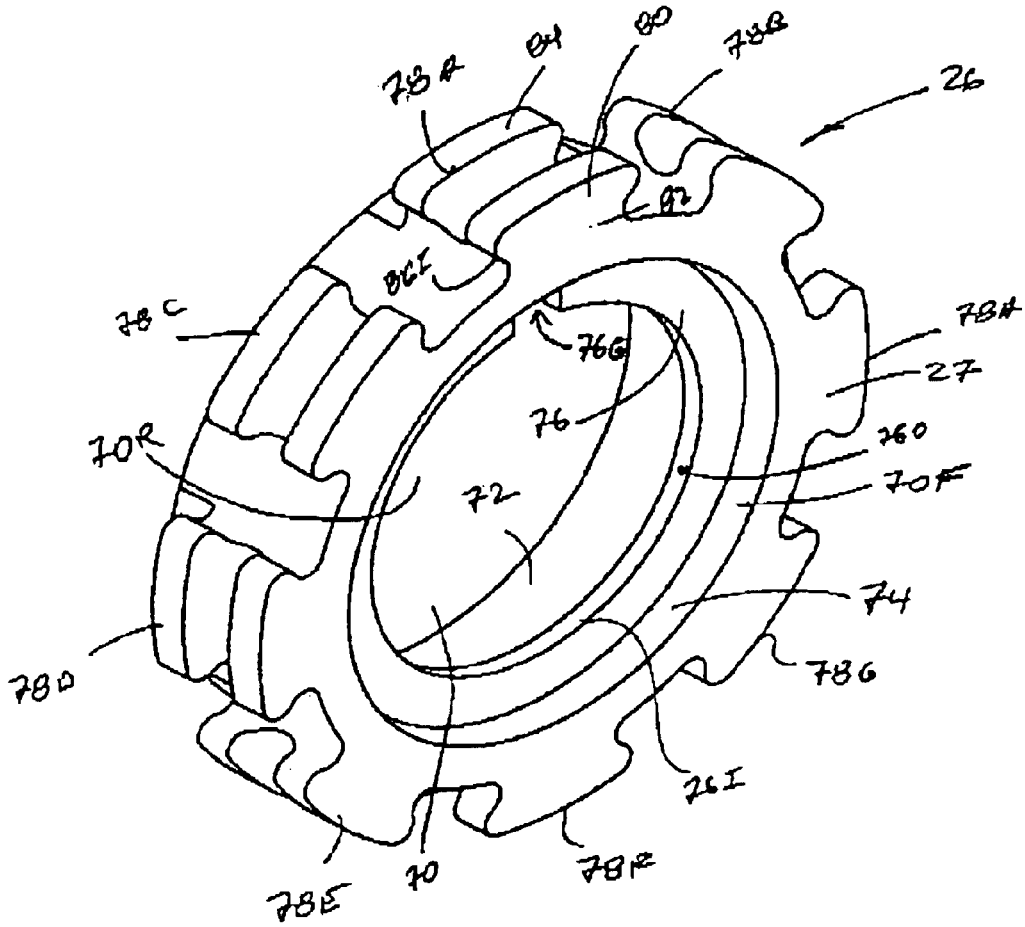
FIG. 7 is a perspective view of a rear mount of the adapter rail system in FIG. 2.
Figure 3:
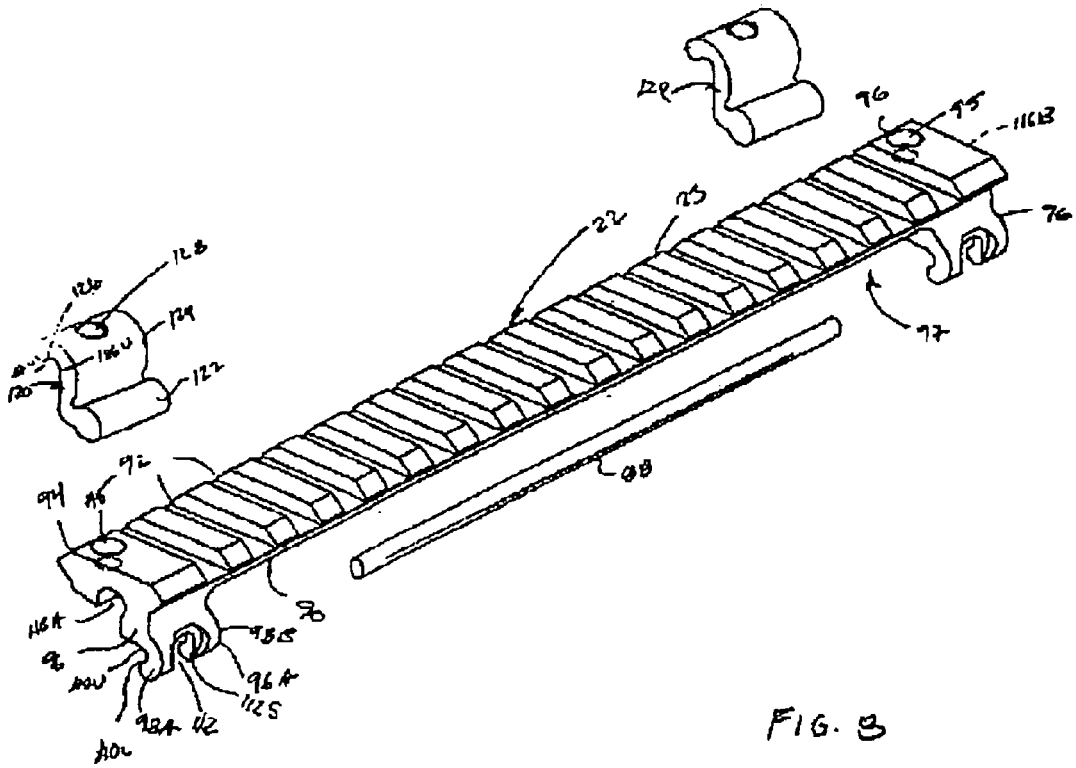

A perspective view of the rear mount 26 is shown in FIG. 7. The rear mount 26 is generally similar to the front mount 24 except as otherwise noted below. The rear mount 26 has a frame 27 which is also a one piece member in this embodiment. The frame may be formed for example by forging, casting, extruding or any other suitable shaping or forming process, from metal such as aluminum alloy, or from any suitable non-metallic materials. As seen in FIG. 7, the frame 27 of the rear mount has a general ring shape similar to frame 25 of the front mount 24. Accordingly, the frame 27 has an inner bore 70 with a front portion 70F and a rear portion 70R. The front and rear portions 70F, 70R of the inner bore are separated by annular flange 76 as shown in FIG. 7. The rear bore portion 70R is sized in length and diameter to cover the wave washers 32 installed on the barrel nut 28 (see FIG. 4). The inner surface 72 may form a clearance fit with the outer surface of wave washers. The annular flange 76 of the rear mount provides a rest surface for the front most wave washer. The opening 76O defined by the inner surface 76I of the annular flange 76 may be sized to form a close sliding fit over the region of barrel nut 28 holding the wave washers, but is otherwise smaller in diameter than the forward lip 28L (see FIG. 4) of the barrel nut. Accordingly, when the rear mount 26 is installed on the firearm, the mount is located with the flange 76 behind the retention lip 28L on the barrel nut 28. This allows the rear mount 26 to slide freely rearwards over the barrel nut 28 but not forwards. The wave washers 32, which are located inside the rear portion 70R of the bore, engage the inner flange 76 of the mount biasing the mount 26 forward against the retention lip 28L of the barrel nut 28 which holds the mount over the barrel nut. The front portion 70F of the inner bore 70 in the rear mount frame 27 is sized to complementarily receive therein the rear end of the hand guard assembly 18. Thus, the front portion 70F of the bore in the rear mount 26 provides a holder for the rear of the hand guard assembly 18 as will be described further below. As seen in FIG. 7, the inner flange 26 has a slot 76G which is cut or otherwise formed therein. The slot 76G provides a clearance passage for the gas tube 30 to extend through the inner flange 76 in the rear mount 26 when the rear mount is installed on the firearm 10.

As seen in FIG. 7, the exterior of the rear mount 26 is substantially similar the exterior of the front mount 24 described before and shown in FIG. 6. Attachment section 78A–78H project radially outwards from the frame exterior. The rear mount in this embodiment has the same number eight (8) of attachment sections 70A–78H as the attachment sections 54A–54H on the front mount 24. The attachment sections 78A–78H are located on frame 27 of the rear mount is substantially the same locations as the attachment sections 54A–54H on the frame 25 of the front mount. Accordingly, as can be seen best in FIGS. 2–3, when the front and rear mount 24, 26 are mounted on the firearm, the mounts provide corresponding pairs of attachment sections (e.g. 54C and 78C, 54D and 78D, 54E and 78E) at opposite ends of the hand guard assembly 18. In this embodiment, the front and rear mounts 24, 26 form eight (8) attachment section pairs distributed equally around the centerline axis C of the firearm barrel. As seen in FIG. 7, the shape of the attachment sections 78A–78H on the rear mount 26 are substantially the same as the shape of attachment sections 54A–54H on the front mount 24. In alternate embodiments, the attachment sections on the rear mount may have a different shape than the attachment sections of the front mount. In this embodiment, each attachment section, such as for example, attachment section 78A has a head portion 80 connected to the mount frame 27 by neck portion 82. The head portion 80 has the generally elliptical profile of the head portion 62 on the attachment sections of the front mount described before and shown in FIG. 6. Head portion 80 has upper seating surface 84 and lower seating surface 86I for the mounting clamps of the rail.

Figure 8A:
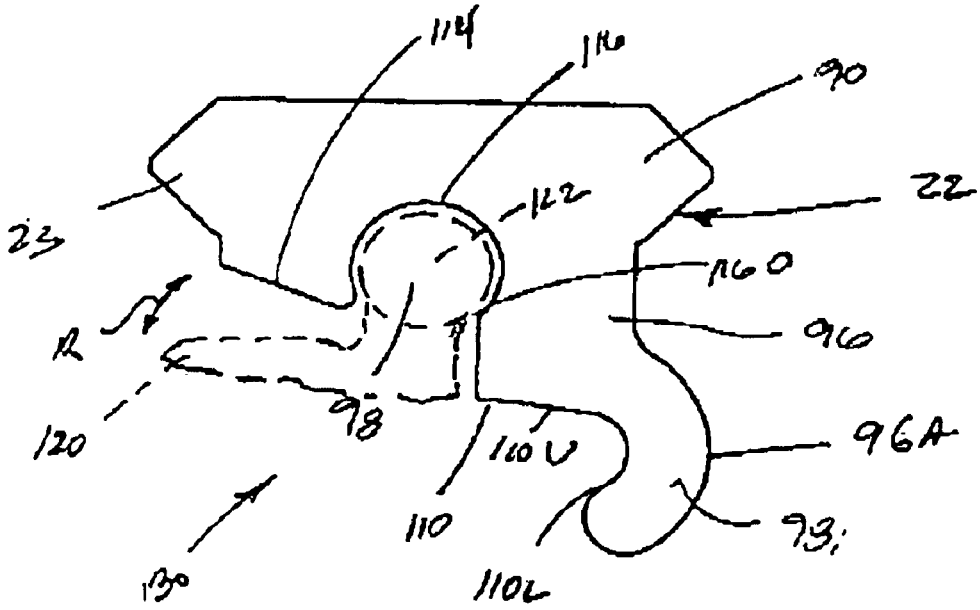

Referring now to FIGS. 8–8A there is shown respectively a perspective view and an end view of the supplemental device mounting rail 22 of the adapter rail assembly 20. The rail 22 shown in FIGS. 8–8A is merely an example of a suitable adapter rail which may be used with the adapter rail assembly 20 and in alternate embodiments, any suitable rail may be used. As seen in FIG. 8, the rail 22 is an elongated member sized to span across the length of the hand guard assembly on the firearm. Accordingly, in the event the adapter rail system is to be installed on a M4 carbine, the rail is sized for the shorter hand guard assembly used on the carbine. In the embodiment shown in FIGS. 8–8A, the rail 22 includes frame 23, stiffening rod 88, and articulated clamp portions 120. Frame 23 may be a one-piece member, or may be an assembly formed from a number of parts. The frame 23 may be extruded from metal or formed in any other suitable manner from a suitable metal or suitable non-metallic material. Forming the rail by a continuous extrusion process allows the rail to be cut to suit to any desired length for use with any desired firearm. The rail frame 23 has an adapter portion 90 and a base or mounting portion 96 (see FIG. 8A). In this embodiment, the adapter portion 90 has a profile in accordance with MIL-STD-1913 for dimensioning of accessory mounting rails for small arms weapons. The adapter portion 90 also has recoil grooves 92 according to MIL-STD-1913. In alternate embodiments, the adapter section of the mounting rail, to which the supplemental devices are mounted, may have any other suitable configuration, including non MIL-STD configurations. As seen best in FIG. 8, the rail frame 23 has extended end section 94, 96 at opposite ends of the rail frame. The extended end sections 94, 96 are without recoil grooves. Each extended section may have a threaded through hole 95 formed therethrough for a set or locking screw 103 (see FIG. 2). As seen best in FIG. 8A, in this embodiment, the base portion 96 extends below the adapter portion 90. The base portion 96 has two base clamps 96A, 96B at opposite ends of the rail frame 23 (see FIG. 8). In this embodiment, a longitudinal gap 97 separates the base clamps 96A, 96B from each other in order to reduce the weight of the rail frame. However, in alternate embodiments, the longitudinal sides of the rail frame may be extended to connect the opposing base clamps to each other. As can be realized from FIG. 8, the base clamps 96A, 96B are substantially similar to each other, and hence, will be described below with specific reference to clamp 96A. Base clamp 96A has a grip portion 98 as shown in FIG. 8A. The grip portion 98 has a general "J" or hook shape which defines an inner seating surface 10. The inner surface 110 of the grip portion 98 generally conforms to the profile (in this case a right hand end portion) of the head portion 62, 84 on any attachment section 54A–54H, 78A–78H of the corresponding mount 24, 26. As can be recognized from FIG. 8, rail 22 may be mounted with either base clamp 96A, 96B located forwards (the head portion 62 on sections 54A–54H, 78A–78H being symmetric so that grip portion 98 may be placed on the left hand portion of the head portion). As seen in FIG. 8, a fastener slot 112 is formed through the grip portion which results in the grip portion 98 being divided into two grip fingers 98A, 98B. The slot is spot faced locally, in this embodiment, to form a seating surface 112S for the head of a clamping fastener placed into slot has an abutment surface 114 located at the opposite edge of the rail from the grip portion 98. A channel 116 is formed as shown in FIG. 8A into the base portion of the rail frame. In this embodiment, the channel 116 has a generally circular cross-section with an opening 1160 at the bottom. The channel 116 has open ends 116A, 116B at opposite ends of the rail which allows the stiffening rod 88 to be inserted into the channel 116. The channel 116 also provides a reliable and simple attachment for the articulated clamp portions 120 to the rail frame 23.

As seen in FIG. 8, stiffening rod 88 is an elongated substantially cylindrical member. In alternate embodiments, the stiffening rod need not have a circular cross-section. The rod 88 may be made of high strength metal or high strength and stiff non-metallic materials such as composites. The rod 88 is sized to form a close fit inside channel 116 in the frame 23. The rod 88 may be inserted into the channel and positioned in a region of maximum stress (i.e. the mid-section of the substantially simply supported rail). The rod 88 may then be tacked or otherwise joined or staked, to the rail frame 23, to form a composite section with the frame 23. As can be realized, an advantage to having a continuous channel 116, is that the continuous channel 116 may be formed in one step during the extrusion process (if such a process is used) of the rail frame 23. This reduces, or eliminates altogether, further machining of slots in the rail frame for mounting the articulated clamping portions 120 to the rail frame. Rod 88, which is made readily at a much lower cost than machining special slots into the rail frame after extrusion, may then be used if desired to strengthen and stiffen the rail longitudinally.

As noted before, the channel 116 in the rail frame 23 provides a reliable and simple means for attaching the articulated claiming portions 120 to the rail frame 23. As can be realized from FIG. 8, one articulated clamping portion 120 is mounted on the rail frame 23 at each base clamp 96A, 96B of the rail, opposite grip portions 98 as will be described further below. The two articulated clamping portions 120 are substantially identical. Each clamping portion 120 may be a one-piece member, cast, forged or otherwise formed from any suitable metal or non-metallic material. The clamping portion 120 has a pin section 122 and a clamping arm 124 extending from the pin section 122 (see FIG. 8). The pin section 122 is generally cylindrical, sized to form a close running fit with the bore of channel 116 in the rail frame. The clamping arm 124, as seen in FIG. 8, has a general hook or "J" shape. The inner surface 126 of the hook shaped arm 124 has a somewhat elliptical shape which generally complements the contour of the top and end surfaces on the head portion 62, 84 on any attachment section of the mounts 24, 26. The inner surface 126 of the clamping arm thus has both an upper seating surface 126U and a lower seating surface 126L to contact corresponding upper and lower seating surfaces 66, 70I, 84, 86I on the attachment sections 54A–54H, 78A–78H of the mounts 24, 26.

As noted before, the articulated clamping portions 120 are readily mounted on the rail frame 23 by inserting the pin section 122 of each clamping portion 120 into channel 116 through the opposite end openings 116A, 116B of the channel FIG. 8A shows part of the one clamping portion 120 (in phantom) when the clamping portion 120 is mounted on the rail frame 23. Pin section 122 in the channel 116 operates as a hinge allowing the clamping portion 120 to rotate relative to the rail frame 23 in the direction indicated by arrow R in FIG. 8A. As can be realized from FIGS. 8–8A, the articulated clamping portion 120 mounted at each base clamp 96A, 96B cooperates with the corresponding grip portion 98 to form a clamp 130 which can be closed around the head portion of any attachment section 54A–54H, 78A–78H of mounts 24, 26. As seen in FIG. 8A, rotation of the clamping portion 120 in the direction to open clamp 130 is limited by abutment surface 114. Surface 114 is angled as desired as shown in FIG. 8A in order to provide adequate rotation to the articulated clamping portion 120 to sufficiently open clamp 130 and allow placement over the head portion of a mount attachment section. Each clamping portion 120 has a threaded hole formed therein to allow engagement of a locking fastener inserted through slot 112 in the grip portion (see FIG. 8).

The adapter rail system 20 is assembled on the M4 type firearm as shown in FIGS. 1–3 (in FIGS. 2–3, the barrel of the firearm is omitted for clarity). The front sight assembly 16 is mounted on and locked to the barrel in the conventional manner so that the sight frame 36 is disposed in the sight plane CY aligned with the centerline C of the barrel. Hence, the key 40 on the sight plane is also aligned to the sight plane CY and with the barrel centerline C (see FIGS. 2–3). The front mount 24 is positioned over the hand guard assembly end cap 34 (see FIG. 4). It is noted that it may be desirable to mount the front and rear mounts 24, 26 of the adapter rail system 20 to the barrel 14 with the barrel disassembled from the firearm. Furthermore, it may be desirable to place at least the front mount 24 over the barrel with the front sight assembly 16 removed from the barrel. When installed, the front mount 24 may be seated with surface 42 against the outer surface of the end cap 34 as noted before. The inner wall 44 of the mount 24 is abutted against the front end of the end cap. As seen in FIGS. 2–3, the rear mounting ring 36B2 of the sight frame 36 is located at least in part into opening 46 of the mount 24. The key 40 on the sight frame 36 is complementingly received into the mount keyway 52 in the mount 24. The interface between key 40 and keyway 52 fixes the front mount 24 in rotational alignment (i.e. about the centerline C) with the sight plane CY and laterally aligned to the barrel centerline C. The attachment sections 54A–54H on the mount 24, which are formed true to the mount 24, are thus fixed on the firearm true relative to the sight plane CY and to the barrel centerline C. The alignment of the front mount 24 to the sight plane CY (rotationally) and to the centerline C (laterally) may vary within a tolerance range corresponding to machine tool accuracy. This is in sharp contrast to conventional adapter rail systems such as rail type hand guards which have an alignment variance that is roughly an order of magnitude larger than the variance of the adapter rail system 20 in this embodiment (e.g. ±3.0° for conventional rail in comparison to about ±0.2° for the instant system). As seen best in FIGS. 2–3, catch 23 is used to lock the lower part of the front mount to the front sight assembly 16. This helps stabilize the front mount 24 in an orientation substantially orthogonal to the sight plane CY. The front latch 23 prevents the mount 24 from becoming canted relative to the barrel centerline C. As seen in FIG. 2, block section 23B of the latch 23 is placed in clevis 37 depending from the rear mounting. A pin 101 is inserted through the clevis 37 and block 23B to hold the latch in the clevis. The extensions member 23E on the catch (see FIG. 6A) abut the front mount with fastener hole 23H in the catch aligned with fastener hole 56 in the mount (see also FIG. 6). Fastener 100 is used to secure the latch 23 to the front mount. The position and orientation of the front mount 24 is thus fixed to the front sight assembly 16 and consequently to the barrel 14 to which the front sight assembly is fixed. Once positioned, the front mount 24 is both accurately aligned to the sight plane CY and barrel centerline C, and also remains locked in this position through use of the firearm. This is not so with conventional rail type hand guard systems which not only are not accurately aligned as noted before, but are also free to "float" relative to the barrel. A further advantage of the adapter rail system 20 in this embodiment is that by locking the front mount 24 to the front sight assembly 16 in the above described manner, the front mount 24, and hence the entire rail system 20, may be accurately aligned to the sight plane CY and barrel centerline C each and every time the mount is installed on the firearm 10 or any other M4 type firearm. The consistency or repeatability in the positioning of the rail system 20 does not exist with conventional adapter rail systems.

Still referring to FIGS. 1–3, the rear mount 26 is located over the barrel nut 28 mounted to the barrel. The wave washers 32 (see FIG. 4) are inside the rear portion 70R of the mount, biased against the inner flange 76 (see also FIG. 7) of the rear mount. This in turn urges the mount flange 76 forwards against the retention lip 28L of the barrel nut shown in FIG. 4. The rear mount 26 is positioned so that the slot 76G (see FIG. 7) in flange 76 is aligned with the gas tube 30, thereby allowing the gas tube to extend through the rear mount 26. As noted before, in this position the attachment sections 78A–78H on the rear mount are generally aligned with corresponding attachment sections 54A–54H on the front mount thereby forming respective attachment section pairs (e.g. 54A and 78A, 54B and 78B) around the barrel.

Moreover, the front portion 70F (see also FIG. 7) of the rear mount 26 provides a holder for the rear end of the hand guard assembly 18. With the adapter rail system 20 in this embodiment, the hand guard assembly 18 may be mounted and removed from the firearm 10 in a conventional manner. By way of example, to install the hand guard assembly 18, the front end of the upper hand guard 18U is inserted into the end cap 34. The rear mount 26 may then be biased to the rear (in the direction of arrow M in FIG. 1) and the hand guard half may be positioned against the barrel 14. The rear mount 26 may then be released, the wave washers 32 urging the mount forwards. When the rear mount 26 is urged forwards by the wave washers, the front portion 70F of the mount captures the rear end of the hand guard half 18U, trapping the hand guard half 18U between the front end cap and rear mount 26. It is desirable to have the rails 22 disconnected from the rear mount 26 when installing the hand guard. The lower hand guard half 18L of the hand guard assembly is installed in a similar manner to the upper hand guard half 18U described above. Removal of the hand guard halves 18U, 18L is performed in a reverse manner to the installation by first sliding the rear mount 26 rearwards (in the direction indicated by arrow M in FIG. 1) to release the rear ends of the hand guard halves and then removing the halves from the front end cap 34. Thus, the front and rear mounts 24; 26 do not interfere with the firearm hand guard assembly 18. The attachment section pairs (e.g. 54A–78A, 54B–78B, 54C–78C etc.) of the front end rear mounts 24, 26 allow mounting of the rail 22 to the firearm without interference with the hand guard assembly 18.

As seen in FIGS. 2–3, the rail 20 is installed by clamping the base clamps 96A, 96B with the articulated clamp portion 120 onto a desired pair (e.g. 54A–78A) of attachment sections of the front and rear mounts 24, 26. FIGS. 2–3 show the adapter rail system 20 with one rail 20 mounted for example purposes only. The adapter rail system 20, however, is capable of mounting a rail similar to rail 22 at every attachment section pair (54A–78A through 54H–78H) on the front and rear mounts 24, 26. Rail 22 is shown in FIGS. 2–3 as being mounted on the top most attachment section pair 54A–78A also for example purposes only. Rail 22, or other rails similar to rail 22 may be mounted on any desired attachment section pair of the front and rear mounts. Hence, the position of one or more rails (similar to rail 22) on the adapter rail system 20 may be selected by the operator as desired. As seen in FIGS. 1–3, the attachment sections of the front and rear mounts are disposed radially from the barrel, so that when rail 22 is mounted to any attachment section pair, the rail 22 is located off from the hand guard assembly 18. A rail or rails mounted to the front and rear mounts 24, 26 does not interfere with the hand guard assembly. Also, as can be realized from FIGS. 2–3, a user may install the rail or rails in positions around the front and rear mounts 24, 26 of the adapter rail system in order to leave a desired portion of the hand guard assembly 18 exposed so that the user may have an unencumbered grasp of the hand guard. By way of example, a right handed user, may grasp the hand guard assembly with the left hand. Accordingly, the user may desire to mount a rail or rails similar to rail 22 on the mounts 24, 26 away from a left side portion of the hand guard assembly 18 so that the user may grab and hold the hand guard assembly from the left side portion without encumbrances from the rails. A left handed user may desire to mount the rails on the mounts 24, 26 in order to grab and hold the hand guard assembly from another desired portion. The rail 22 may be readily mounted to the desired attachment section pair. Such as for example, attachment sections 54A–78A (as shown in FIGS. 2–3) by opening the hinged clamp portion 120, as described before, and placing the base clamps 96A, 96B and clamp portions 120 around the corresponding attachment section. The base clamps 96A, 96B and clamp portions 120 are then closed by inserting fasteners 200 through the slot in the base clamp into the threaded hole 128 (see FIG. 8) of the corresponding clamp portion 120. This draws the clamp portion 120 towards the base clamp 96A, 96B thereby clamping the head portion on the attachment section of the mount in between. The generally elliptical seating surface 126U, 126L and 110U, 110L on the clamp portion 120 and base clamp 96A, 6B respectively are seated against the generally elliptical surfaces 66, 70I, 84, 86I on the head portions 62, 80 of the front and rear mounts 24, 26. As noted before, the elliptical shape of the respective seating surfaces on both the rail and mounts helps ensure that contact between the base clamp/clamp portion of the rail 22 and corresponding head portion 62, 80 exists at least at two opposing locations along the upper surface 66, 80 and at two more opposing location s on the inner surface 70I, 86I of the he ad section 62, 80 to which the rail is mounted. The result is that the rail 22 is always stably held on the mounts. To further secure the rail to the mounts 24, 26 lock fasteners 103 (see FIG. 2) are engaged against the hinged clamp portion 120.

Figure 9:
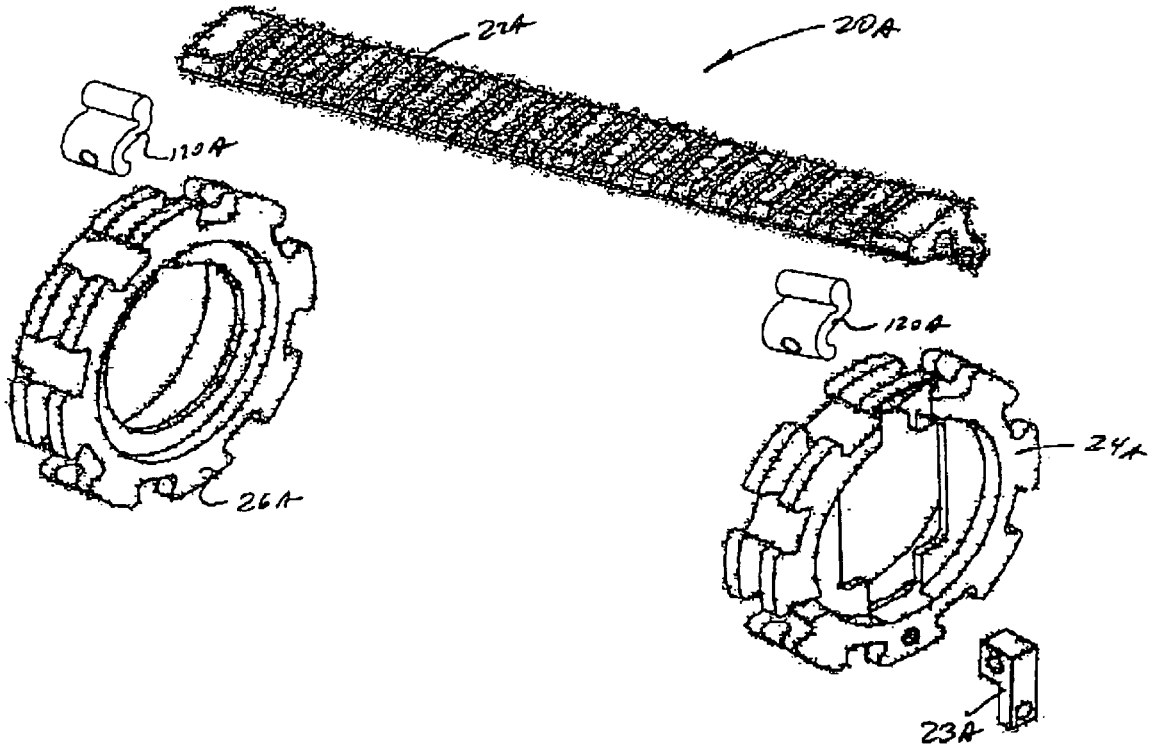
FIG. 9 is a perspective view of an adapter rail system for a firearm in accordance with another embodiment of the invention.

Referring now to FIG. 9, there is shown a respective view of an adapter rail system kit 20A which may be mounted to an M4 type firearm in this embodiment. The kit 20A includes the front mount 24A, the rear mount 26A, adapter rail 22A, articulated clamp portions 120A and catch 23A. The components of the kit 20A (i.e. the front mount 24A, the rear mount 26A, adapter rail 22A clamp portion 120A, catch 23A) are substantially the same as the corresponding parts of the rail system 20 described before and shown in FIGS. 1–8A. Similar parts are similarly numbered.

The adapter rail system 20 provides significant advantages over the conventional rail systems used for securing supplemental devices to that firearm as described before. Rail system 20 allows for the mounting of a number of rails 22 as selected by the user. The rail or rails may be mounted in a number of positions as selected by the user. The rails when mounted do not interfere with the conventional hand guard assembly 18 of the firearm. The rail or rails are held in a fixed geometry which is aligned with the sight plane CY and centerline C of the firearm barrel. The rail or rails may be installed with ease. The rail or rails may be repeatedly installed with consistent alignment accuracy far superior to conventional rail systems.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A firearm rail adapter system for mounting accessories on a firearm, the system comprising:

a first mount adapted to be mounted to the firearm, and having rail attachment sections thereon;

a second mount adapted to be mounted to the firearm and having other rail attachment sections thereon; and an adapter rail adapted to be removably mounted to at least one of the rail attachment sections of the first mount and to at least one of the other rail attachment sections of the second mount, the rail attachment sections and the other rail attachment sections being disposed respectively on the first mount and second mount so that when the first mount and second mount are mounted to the firearm, the first mount and second mount each provide a number of different selectable mounting stations for mounting the adapter rail to the firearm with the adapter rail positioned in different selectable positions around the firearm.

2. The system as in claim 1, wherein the different selectable mounting stations are in different positions with respect to a reference datum of the firearm.

3. The system as in claim 1, wherein the first mount and second mount are mounted to a barrel of the firearm, the first mount and second mount being spaced apart longitudinally along the barrel.

4. The system as in claim 2, wherein the first mount has a frame which is a one-piece member, and the second mount has a frame which is a one-piece member.

5. The system as in claim 1, wherein when the first mount and second mount are mounted on the firearm, the first mount and second mount bracket a handguard on a barrel of the firearm.

6. The system as in claim 1, wherein the first mount and second mount support the adapter rail off a handguard on a barrel of the firearm.

7. The system as in claim 2, wherein the first mount has a frame that has a general ring shape, and the second mount has a frame that has a general ring shape.

8. The system as in claim 7, wherein the frame of the first mount has at least one projecting member projecting radially outwards from the frame, the at least one projecting section forming at least one of the rail attachment sections of the first mount.

9. The system as in claim 8, wherein the at least one projecting member has a seating section at a distal end of the projecting member for seating a mounting surface of the adapter rail when the adapter rail is mounted on the first mount.

10. The system as in claim 9, wherein the seating section has generally opposed outer and inner seating surfaces which are generally curved to effect contact between the mounting surface of the adapter rail and the seating section at least at opposing ends of the outer seating surface and opposing ends of the inner seating surface for stably holding the adapter rail on the first mount.

11. The system as in claim 7, wherein the frame of the first mount has an inner surface adapted to be seated on a front handguard cap of the firearm.

12. The system as in claim 7, wherein when the first mount is mounted to the firearm, the frame of the first mount is interlocked with a predetermined fixture of the firearm, said predetermined fixture being aligned with a firearm barrel centerline and sight plane to a predetermined accuracy, and wherein the interlock between the first mount and predetermined fixture aligns the first mount and the adapter rail mounted to the first mount to the barrel centerline and sight plane.

13. The system as in claim 1, wherein, the at least one rail is an elongated member having an accessory mounting section in accordance with MIL-STD-1913 for mounting firearm accessories, and wherein the rail is an extrusion.

14. A firearm rail adapter system for mounting accessories on a firearm, the system comprising:

a first mount adapted to be mounted to the firearm, and having rail attachment sections thereon;

a second mount adapted to be mounted to the firearm and having other rail attachment sections thereon; and an adapter rail adapted to be removably mounted to at least one of the rail attachment sections of the first mount and to at least one of the other rail attachment sections of the second mount, the rail attachment sections and the other rail attachment sections being disposed respectively on the first mount and second mount so that when the first mount and second mount are mounted to the firearm, the first mount and second mount provide a number of different selectable mounting stations for mounting the adapter rail to the firearm, wherein the first mount has a frame that has a general ring shape, and the second mount has a frame that has a general ring shape, and wherein the first mount has eight rail attachment sections disposed around a circumference of the frame of the first mount.

15. A firearm rail adapter system for mounting accessories on a firearm, the system comprising:

a first mount adapted to be mounted to the firearm, and having rail attachment sections thereon;

a second mount adapted to be mounted to the firearm and having other rail attachment sections thereon; and an adapter rail adapted to be removably mounted to at least one of the rail attachment sections of the first mount and to at least one of the other rail attachment sections of the second mount, the rail attachment sections and the other rail attachment sections being disposed respectively on the first mount and second mount so that when the first mount and second mount are mounted to the firearm, the first mount and second mount provide a number of different selectable mounting stations for mounting the adapter rail to the firearm, wherein the first mount has a frame that has a general ring shape, and the second mount has a frame that has a general ring shape, and wherein the second mount has eight rail attachment section disposed around a circumference of the frame of the second mount.

16. A firearm rail adapter system for mounting accessories on a firearm, the system comprising:

a first mount adapted to be mounted to the firearm, and having rail attachment sections thereon;

a second mount adapted to be mounted to the firearm and having other rail attachment sections thereon; and an adapter rail adapted to be removably mounted to at least one of the rail attachment sections of the first mount and to at least one of the other rail attachment sections of the second mount, the rail attachment sections and the other rail attachment sections being disposed respectively on the first mount and second mount so that when the first mount and second mount are mounted to the firearm, the first mount and second mount each provide a number of different selectable mounting stations for mounting the adapter rail to the firearm, wherein when the first mount is mounted to the firearm, the frame of the first mount is interlocked with a predetermined fixture of the firearm, said predetermined fixture being aligned with a firearm barrel centerline and sight plane to a predetermined accuracy, and wherein the interlock between the first mount and predetermined fixture aligns the first mount and the adapter rail mounted to the first mount to the barrel centerline and sight plane, and wherein the predetermined fixture is a front sight piece of the firearm, and wherein the frame has a keyway formed therein, the keyway being engaged to a portion of the front sight piece to interlock the first mount to the front sight piece.

17. The system as in claim 16, wherein the portion of the front sight piece is a key formed on the front sight piece.

18. A firearm rail adapter system for mounting accessories on a firearm, the system comprising:

a first mount adapted to be mounted to the firearm, and having rail attachment sections thereon;

a second mount adapted to be mounted to the firearm and having other rail attachment sections thereon; and an adapter rail adapted to be removably mounted to at least one of the rail attachment sections of the first mount and to at least one of the other rail attachment sections of the second mount, the rail attachment sections and the other rail attachment sections being disposed respectively on the first mount and second mount so that when the first mount and second mount are mounted to the firearm, the first mount and second mount provide a number of different selectable mounting stations for mounting the adapter rail to the firearm, wherein when the second mount is mounted to the firearm, the second mount is spring biased against a handguard of the firearm to hold the handguard on the firearm.

19. The system as in claim 18, wherein the second mount has a frame with an annular recess for receiving therein an end of the handguard.

20. A firearm rail adapter system for mounting accessories on a firearm, the system comprising:

a first mount adapted to be mounted to the firearm, and having rail attachment sections thereon;

a second mount adapted to be mounted to the firearm and having other rail attachment sections thereon; and an adapter rail adapted to be removably mounted to at least one of the rail attachment sections of the first mount and to at least one of the other rail attachment sections of the second mount, the rail attachment sections and the other rail attachment sections being disposed respectively on the first mount and second mount so that the adapter rail can be mounted in a position on the firearm selected from a number of different selectable positions around the firearm, said selectable positions being different relative to a predetermined reference datum of the firearm.

21. A firearm rail adapter system for mounting accessories on a firearm, the system comprising:

a first mount adapted to be mounted to the firearm, and having rail attachment sections thereon;

a second mount adapted to be mounted to the firearm and having other rail attachment sections thereon; and an adapter rail adapted to be removably mounted to at least one of the rail attachment sections of the first mount and to at least one of the other rail attachment sections of the second mount, the rail attachment sections and the other rail attachment sections being disposed respectively on the first mount and second mount to allow the adapter rail to be mounted on the firearm with the adapter rail selectably positioned in one from a number of different selectable positions, the different selectable positions being located around a predetermined reference datum of the firearm.

22. The system as in claim 21, wherein the first mount has locating surfaces for interlocking the first mount when mounted to the firearm with a predetermined fixture of the firearm, the interlock between the first mount and predetermined fixture aligning at least one of the rail attachment sections of the first mount with a predetermined reference datum of the firearm to which the predetermined fixture is aligned.

23. The system as in claim 21, wherein the second mount has a receptacle formed therein for conjugally receiving therein an end of a handguard of the firearm.

24. The system as in claim 22, wherein the adapter rail has an accessory mounting section in accordance with MIL-STD-1913, and includes mounts adapted to affix to rail attachment sections of the first mount and second mount, and wherein at least one of the mounts of the adapter rail is relative to the accessory mounting section so that when the at least one of the mounts is affixed to the at least one rail attachment section the accessory mounting section is substantially aligned to the predetermined reference datum.

25. A firearm rail adapter system for mounting accessories on a firearm, the system comprising:

at least one adapter rail adapted for removably mounting firearm accessories thereon, the at least one rail having front and rear rail attachment sections for attaching the rail to the firearm;

a front mount disposed proximal to a front end of a barrel of the firearm; and a rear mount disposed proximal to a rear end of the barrel;

wherein the front and rear mounts mount the at least one rail to the barrel of the firearm, the front mount being adapted to removably mate with the front rail attachment section and the rear mount being adapted to removably mate with the rear rail attachment section, the at least one rail being removably mountable, in a number of different selectable positions around the barrel, on the front and rear mounts.

26. The system as in claim 25, wherein the at least one adapter rail is an elongated member having a mounting section in accordance with MIL-STD-1913 for mounting firearm accessories.

27. The system as in claim 25, wherein the front mount has attachment members at different positions on the front mount, a number of the attachment members being removably mateable to the front rail attachment section so that the at least one adapter rail can be mounted in different selectable positions on the front mount.

28. The system as in claim 25, wherein the rear mount has attachment members at different positions on the front mount, a number of the attachment members being removably mateable to the rear rail attachment section so that the at least one rail can be mounted in different selectable positions on the rear mount.

29. A firearm comprising:

a receiver;

a barrel connected to the receiver;

a handguard connected to the barrel; and an adapter rail mounting system for mounting accessories to the firearm, the system comprising mounts with a number of different adapter rail attachment sections for attaching an adapter rail to the firearm, the different attachment sections allowing the adapter rail to be mounted to the firearm with the adapter rail placed in a number of different selectable positions around the barrel of the firearm.

30. A kit comprising:

an adapter rail adapted for mounting accessories to a firearm;

a first mount element for connecting the adapter rail to the firearm; and a second mount element for connecting the adapter rail to the firearm, wherein the adapter rail can be selectably mounted in a number of different positions around the first mount element.

31. The kit as in claim 30, wherein the adapter rail has an accessory mounting portion conforming to MIL-STD-1913.

32. The kit as in claim 30, further comprising a locking bracket adapted to be connected to the first mount element and lock the first mount element to a predetermined portion of a firearm when the first mount element is mounted on the firearm.

33. The kit as in claim 30, wherein the first mount element has a frame which is a one-piece member, and the second mount element has a frame which is a one-piece member.

34. The kit as in claim 33, wherein the frame of the first mount element is an extrusion made of metal.

35. The kit as in claim 33, wherein the frame of the first mount element has multiple rail attachment areas for attaching the adapter rail to the first mount element, the multiple rail attachment areas allowing the rail to be mounted in a number of different positions on the first mount element.

36. The kit as in claim 33, wherein the frame of the second mount element has multiple rail attachment areas for attaching the adapter rail to the second mount element, the multiple rail attachment areas allowing the rail to be mounted in a number of different positions on the second mount element.

* * * * *

UNITED STATES PATENT AND TRADEMARK OFFICE

CERTIFICATE OF CORRECTION

PATENT NO. : 6,792,711 B2
DATED : September 21, 2004
INVENTOR(S) : Battaglia

It is certified that error appears in the above-identified patent and that said Letters Patent is hereby corrected as shown below:

Column 16,
Lines 26 and 36, “2” should read -- 1 --.

Signed and Sealed this

Twenty-seventh Day of September, 2005

JON W. DUDAS
*Director of the United States Patent and Trademark Office*